US006363991B1

(12) United States Patent
Huang

(10) Patent No.: US 6,363,991 B1
(45) Date of Patent: Apr. 2, 2002

(54) MULTI-PURPOSE STATIONARY ASSEMBLY

(76) Inventor: Te-Ming Huang, 1F, No. 6, Lane 43, Shui-Yuan Rd., Taipei (TW)

( * ) Notice: Subject to any disclaimer, the term of this patent is extended or adjusted under 35 U.S.C. 154(b) by 0 days.

(21) Appl. No.: 09/480,384

(22) Filed: Jan. 10, 2000

(51) Int. Cl.[7] ..... B32B 31/00

(52) U.S. Cl. ..... 156/577; 156/574; 225/6; 242/590

(58) Field of Search ..... 156/510, 523, 156/527, 574, 577, 579; 225/6; 242/590

(56) References Cited

U.S. PATENT DOCUMENTS 2,110,912 A * 3/1938 Krueger ..... 91/14.5
2,671,917 A * 3/1954 Martin et al. ..... 15/104
2,730,990 A * 1/1956 Gray et al. ..... 118/235
3,636,408 A * 1/1972 Shuman ..... 317/2 R
6,235,369 B1 * 5/2000 Shepard et al. ..... 428/85

* cited by examiner

*Primary Examiner*—James Sells
(74) *Attorney, Agent, or Firm*—Ostrolenk, Faber, Gerb & Soffen, LLP

(57) ABSTRACT

A multi-purpose stationary assembly, wherein the paper weight, adhesion tape rack, and paper stand & memo holder are combined as a whole, by including a casing and a weight is connected to a bottom of the casing so that the casing can serve as a paper weight. A slot is defined in a top of the casing for sheets of paper to be held therein. A roll of adhesive tape is received in the casing and an extension arm is pivotally engaged with a cut-away in the casing, wherein the extension arm has a toothed edge so as to cut the tape.

24 Claims, 7 Drawing Sheets

MULTI-PURPOSE STATIONARY ASSEMBLY

FIELD OF THE INVENTION

The present invention relates to a multi-purpose stationary assembly, wherein an adhesive tape rack is received into the multi-purpose stationary assembly whose main body can be used as a paper weight; an extension arm having a toothed edge is pivotably connected to the outside of the paper weight. A slot is defined in the multi-purpose stationary assembly so as to be used as a paper stand & memo holder.

BACKGROUND OF THE INVENTION

Desktop equipment includes various types of facilities such as paper weights, letter punches, paper stand & memo holders and adhesive tape rack. Each of which occupies a space on the desktop so that the user has to arrange them not to affect his/her daily work on the desk. Therefore, an organizer is developed and has a plurality of recesses or chambers to receive erasers, clips, pencils or scissors. However, these conventional organizers only provide many small spaces to receive tiny stuff and, in fact, these tiny clips, erasers occupy variously limited space on the desktop.

The present invention intends to provide a multi-purpose stationary assembly in which an adhesive tape is received into a paper weight and a slot is defined in a top of the paper weight so as to be used as a paper stand & memo holder. The body of the paper weight includes a pivotal extension arm which is a part of the shape of the paper weight and when the extension arm is pivoted away from the paper weight, the adhesive tape can be cut by the toothed edge on the extension arm.

SUMMARY OF THE INVENTION

In accordance with one aspect of the present invention, there is provided a multi-purpose stationary assembly comprising a paper weight, wherein a casing is composed of a first portion and a second portion. A weight is connected to a bottom of the first portion. The first portion has a closed end and an open end. Two first flanges extend from two sides of a distal end defining the open end and the second portion has two second flanges extending from two sides of an end thereof so that when the second portion is engaged with the open end of the first portion, a slot is defined in a top of the casing and between the two first flanges and the two second flanges.

The object of the present invention is to provide a multi-purpose stationary assembly wherein the paper weight has a roll of the adhesive tape received. An extension arm is pivotally engaged with a cut-away defined in the casing of the paper weight, the extension arm having a toothed edge so as to cut the tape.

Another object of the present invention is to provide a multi-purpose stationary assembly wherein a slot is defined in a top of the casing of the paper weight so as to be used as a paper stand & memo holder.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
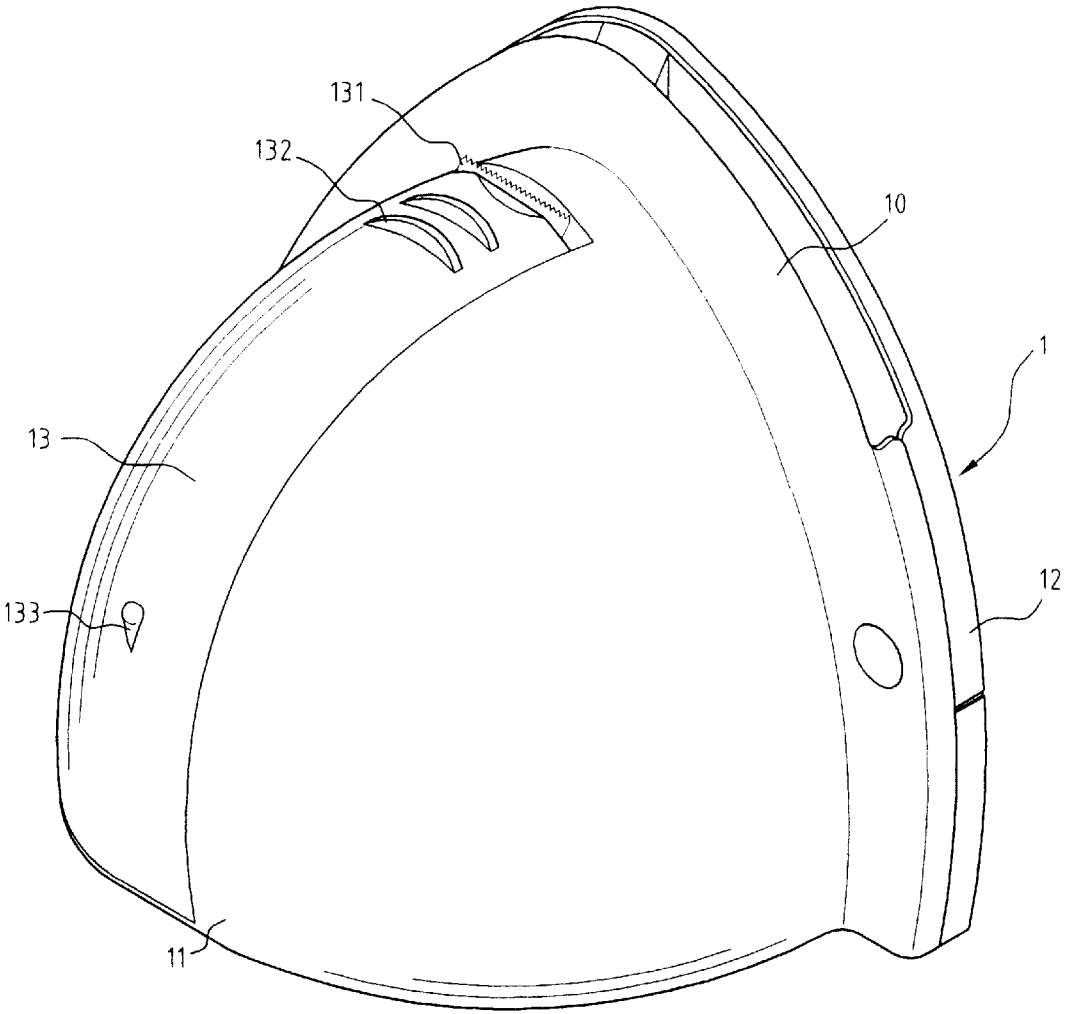
FIG. 1 is a perspective view to show the present invention.
Figure 2:
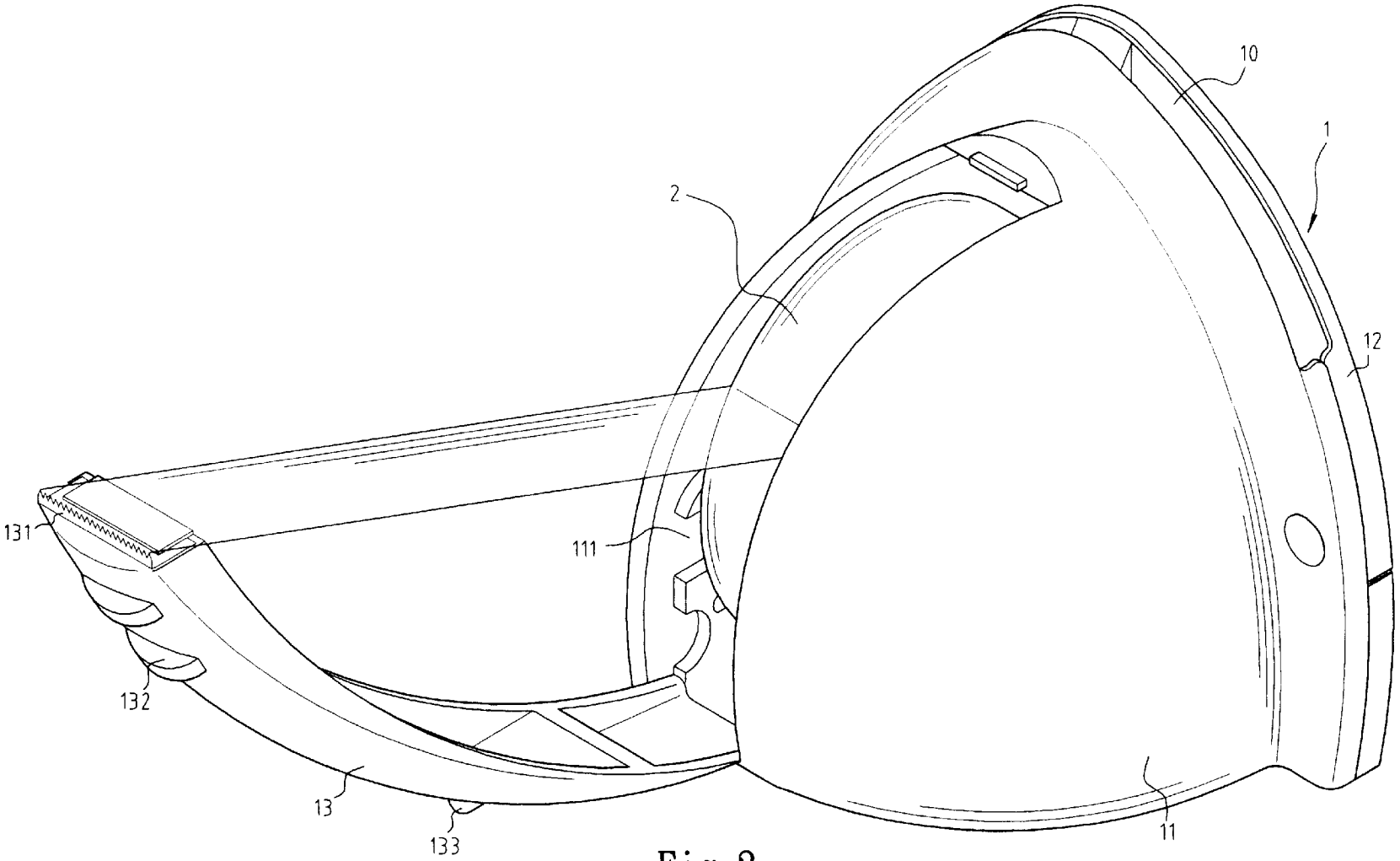
FIG. 2 is a perspective view to show an extension arm is pivoted away from the casing of the multi-purpose stationary assembly and a section of a adhesive tape is adhered on the extension arm which has a toothed edge.
Figure 3:
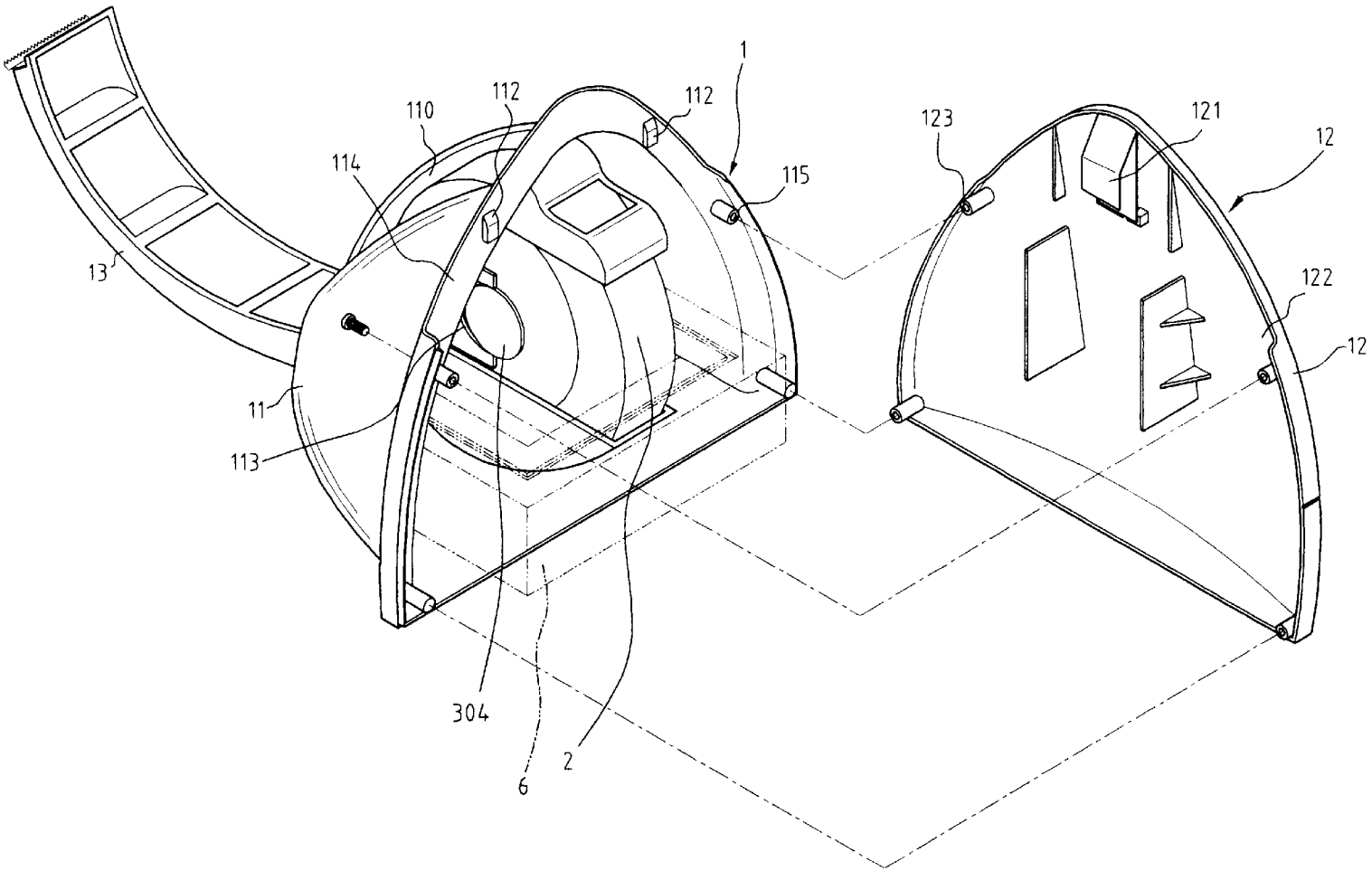
FIG. 3 is an exploded view to show the two portions composing the casing of the present invention.
Figure 4:
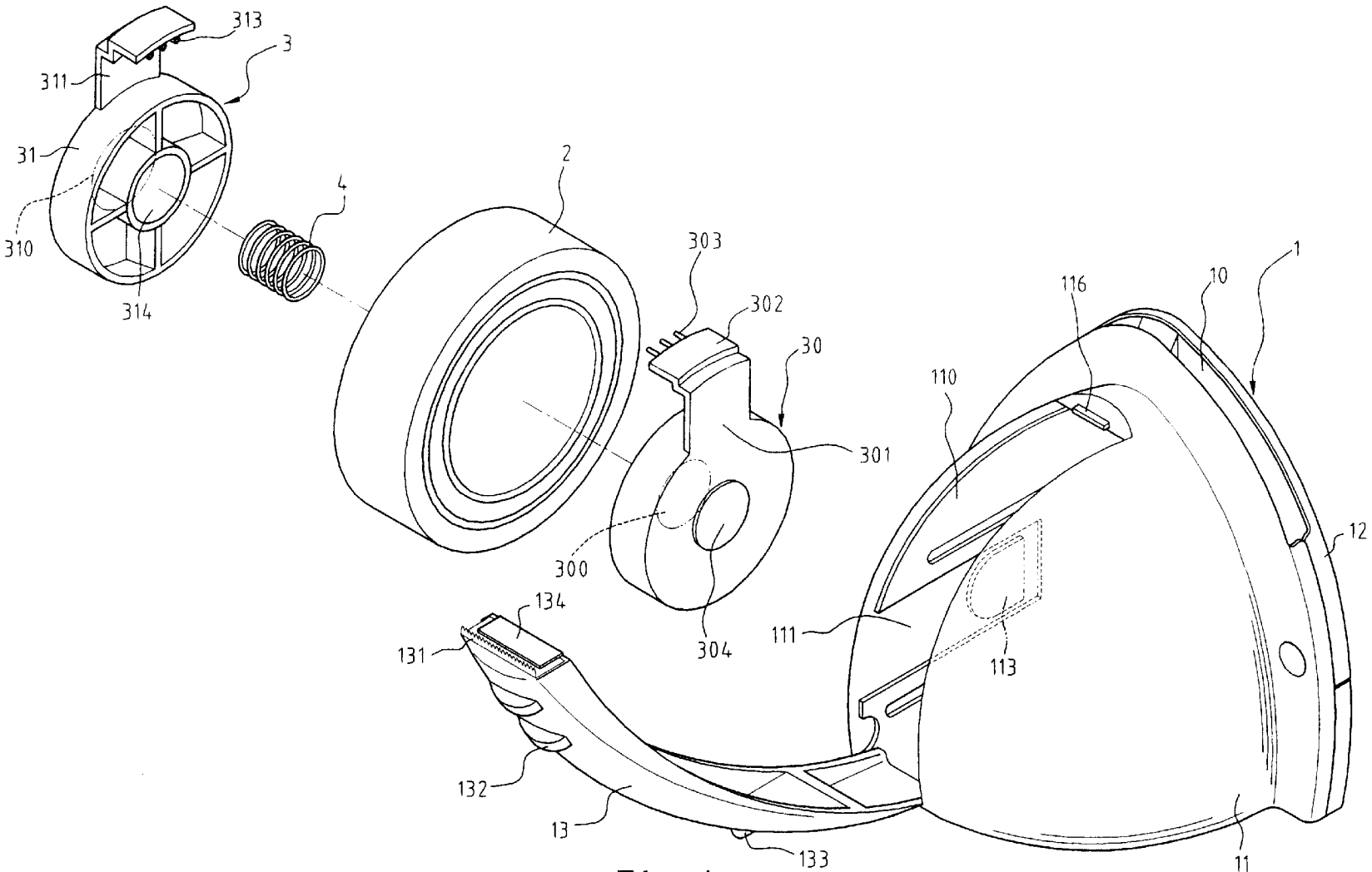
FIG. 4 is an exploded view to show a roll of adhesive tape and the two parts that compose the support means engaged with the roll of the adhesive tape.
Figure 5:
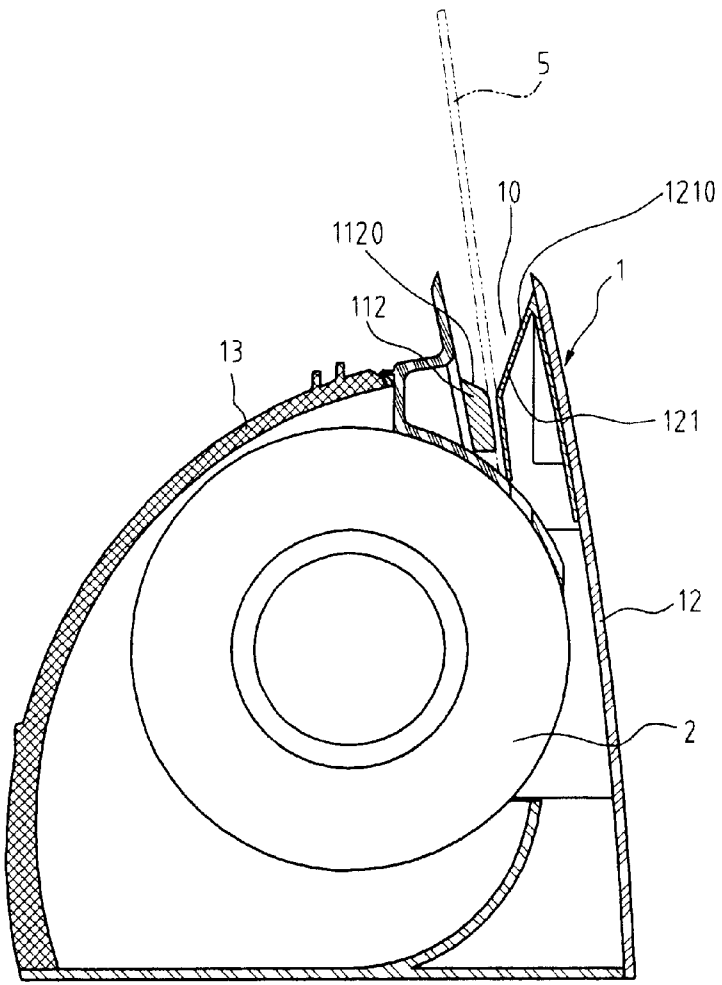
FIG. 5 is a cross-sectional view to show memo sheets are clamped in the slot in the top of the casing of the present invention.

Referring to FIGS. 1 to 4, the multi-purpose stationary assembly in accordance with the present invention comprises a casing 1 which includes a first portion 11 and a second portion 12. The first portion 11 has a closed end and an open end, and a weight 6 is connected to a bottom of the first portion 11 so as to be used as a paper weight. Two first flanges 113 extend from two sides of a distal end 114 defining the open end and two protrusions 112 extend from the distal end 114, wherein the two protrusions 112 are located between the two first flanges 113 and each protrusion 112 has an inclined surface 1120 defined in a top thereof as shown in FIG. 5. A plurality of first tubes 115 extend from the distal end 114 defining the open end of the first portion 11, and each first tube 115 has a threaded recess defined therein. A cut-away 110 is defined through the closed end of the first portion 11 and an extension arm 13 is able to be pivotally engaged with the cut-way 110. The extension arm 13 has a toothed edge 131 defined in a distal end of the extension arm 13. The extension arm 13 has a plurality of ribs 132 extending from an outside of the extension arm 13 so that the user may conveniently pull the extension arm 13 from the first portion 11. A pad member 133 extends from an outside of the extension arm 13 so as to contact a desktop (not shown) to support the extension arm 13.

Two grooves 111 are respectively defined in an inside of the first portion 11 so that a roll of adhesive tape 2 is engaged with the grooves 111. A dent 113 is defined in a bottom defining each groove 111. A support means 3 is engaged with the roll of adhesive tape 2 and engaged with the two grooves 111. The support means 3 has two parts 30, 31 and each part 30/31 has a central recess 300/314 in an inside thereof so that the roll of adhesive tape 2 is located between the two parts 30, 31. Each part 30/31 has a shaft 304/310 extending from an outside thereof and the two respective shafts 304, 310 are rotatably supported in the two dents 113. A spring 4 extends through the roll of adhesive tape 2 and is received in the two central recesses 300, 314 so that the two parts 30, 31 are pushed to engage with the dents 113 by the spring 4. Each part 30/31 has an L-shaped extension board 301/311 extending radially outward therefrom, the extension board 302 having pins 303 extending therefrom and the extension board 311 having holes 313 defined therein for receiving the pins 303 therein. A leading end of the adhesive tape 2 is connected to the toothed edge 131 of the extension arm 13 and the tape 2 can be cut by the toothed edge 131.

Figure 6:
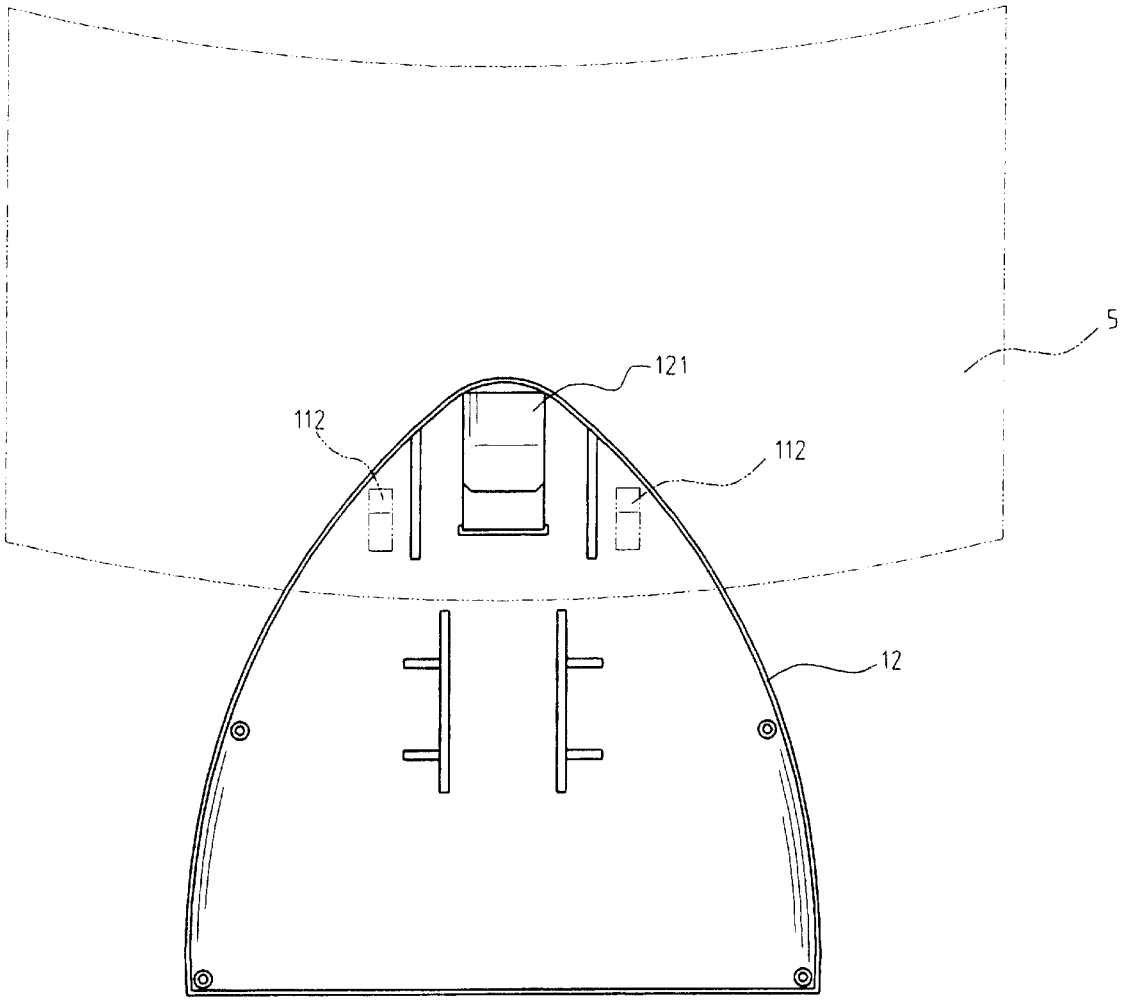
FIG. 6 is an illustrative view seen from the rear end of the casing and the memo sheets clamped in the slot.
Figure 7:
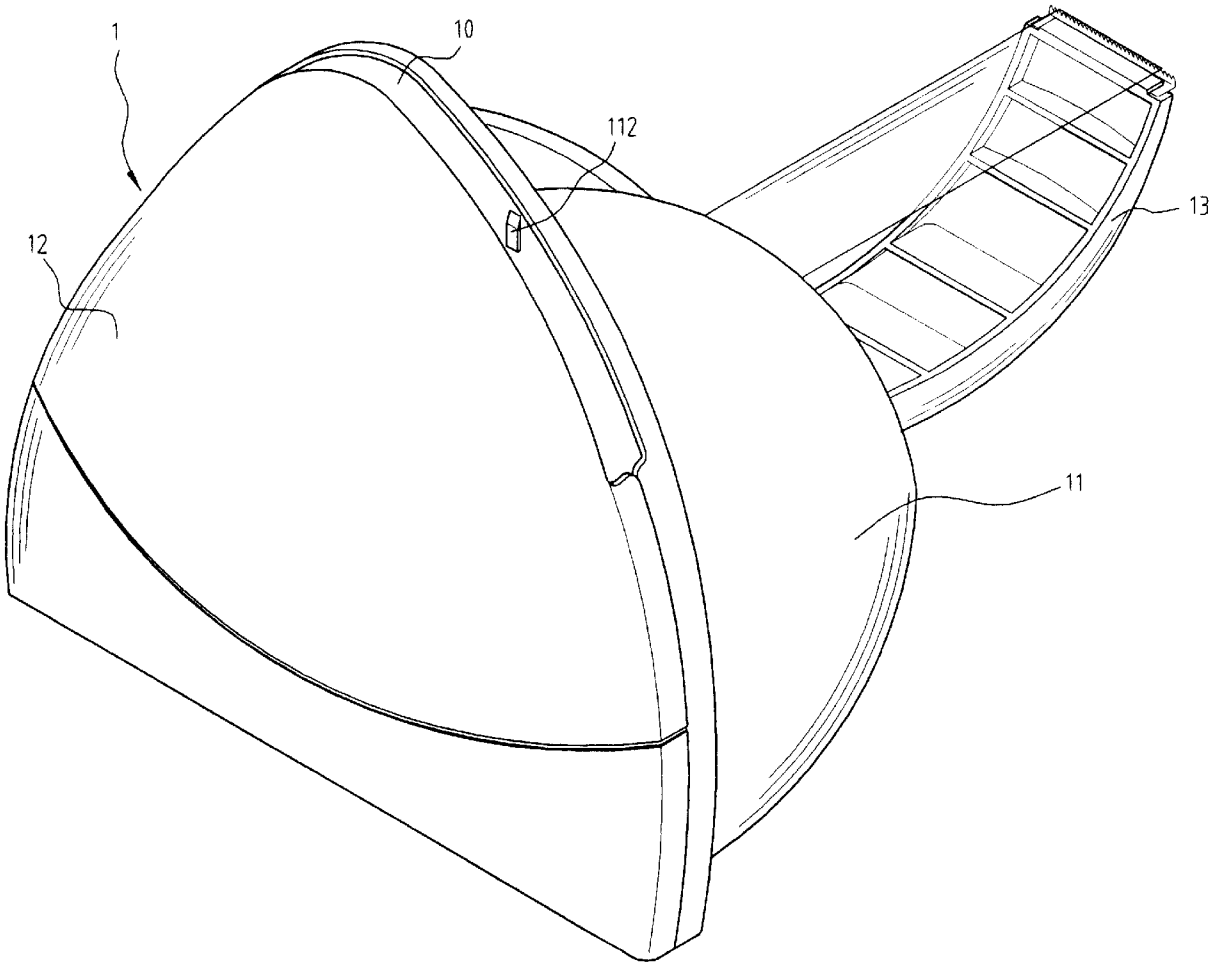
FIG. 7 is a perspective view seen from the rear end of the present invention wherein the extension arm is pivoted outward.

The second portion 12 has two second flanges 120 extending from two sides of an end of the second portion 12, and a flexible plate 121 extends from the end having the second flanges 120 of the second portion 12. The flexible plate 121 located between the two second flanges 120 and an inclined surface 1210 is defined in a top of the flexible plate 121 as shown in FIG. 5. Besides, a plurality of second tubes 123 extend from the end having the second flanges 120 and the second tubes 123 are located in alignment with the first tubes 115. Therefore, the second portion 12 is engaged with the open end of the first portion 11 with bolts extending through the second tubes 123 of the second portion 12 and engaged with the first tubes 115. A slot 10 is defined between the two first flanges 113 and the two second flanges 120 so that memo sheets 5 are inserted in the slot 10 and clamped between the flexible plate 121 and the protrusions 112 as shown in FIGS. 5 and 6.

When the extension arm 13 is engaged with the cut-away of the first portion 11, the paper weight, adhesive tape rack, and paper stand & memo holder serve as a whole stationary assembly with a smooth outer appearance. The extension arm 13 is easily and conveniently pivoted outward and the tape 2 can be cut by the toothed edge 131 on the extension arm 13. This multi-purpose stationary assembly occupies a small space on the desktop and involves three functions.

While we have shown and described various embodiments in accordance with the present invention, it should be clear to those skilled in the art that further embodiments may be made without departing from the scope and spirit of the present invention.

What is claimed is:

1. A multi-purpose stationary assembly comprising:

a casing which includes a first portion and a second portion, said first portion having a closed end and an open end, two first flanges extending from two sides of a distal end defining said open end, a weight connected to a bottom of said first portion so that the casing can serve as a paper weight, and said second portion having two second flanges extending from two sides of an end of said second portion, said second portion engaged with said open end of said first portion, said two first flanges respectively contacting said second flanges, a slot defined between said two first flanges and said two second flanges.

2. The multi-purpose stationary assembly as claimed in claim 1, wherein said distal end defining said open end of said first portion has two protrusions extending therefrom, said two protrusions located between said two first flanges, a flexible plate extending from said end having said second flanges of said second portion and said flexible plate located between said two second flanges.

3. The multi-purpose stationary assembly as claimed in claim 2 further comprising an inclined surface defined in a top of each protrusion, an inclined surface defined in a top of said flexible plate.

4. The multi-purpose stationary assembly as claimed in claim 1 further comprising a plurality of first tubes extending from said distal end defining said open end of said first portion, each first tube having a threaded recess defined therein, a plurality of second tubes extending from said end having said second flanges and said second tubes located in alignment with said first tubes.

5. The multi-purpose stationary assembly as claimed in claim 1 further comprising a roll of adhesive tape rotatably received in said first portion, an extension arm pivotally connected to said first portion and a toothed edge defined in a distal end of said extension arm.

6. The multi-purpose stationary assembly as claimed in claim 5 further comprising a cut-away defined through said first portion and said extension arm which is able to be engaged with said cut-way.

7. The multi-purpose stationary assembly as claimed in claim 5 further comprising a plurality of ribs extending from an outside of said extension arm.

8. The multi-purpose stationary assembly as claimed in claim 5 further comprising a pad member extending from an outside of said extension arm.

9. The multi-purpose stationary assembly as claimed in claim 5 further comprising two grooves defined in an inside of said first portion, a support means engaged with said roll of adhesive tape and engaged with said two grooves.

10. The multi-purpose stationary assembly as claimed in claim 9, wherein said support means has two parts and each part has a central recess, said roll of adhesive tape located between said two parts and a spring extending through said roll of adhesive tape and engaged between said two central recesses in said two parts.

11. The multi-purpose stationary assembly as claimed in claim 10, wherein each part has a shaft extending therefrom and a dent defined in a bottom defining each groove, said two respective shafts rotatably supported in said two dents.

12. The multi-purpose stationary assembly as claimed in claim 9, wherein each part has an extension board extending radially outward therefrom, one of said extension boards having pins extending therefrom and the other extension board having holes defined therein for receiving said pins therein.

13. A multi-purpose stationary assembly comprising:

a casing which includes a first portion and a second portion, said first portion having a closed end and an open end, a weight connected to a bottom of said first portion, said second portion engaged with said open end of said first portion, a roll of adhesive tape rotatably received in said first portion, an extension arm pivotally connected to said first portion and a toothed edge defined in a distal end of said extension arm.

14. The multi-purpose stationary assembly as claimed in claim 13 further comprising a cut-away defined through said first portion and said extension arm engageable with said cut-way.

15. The multi-purpose stationary assembly as claimed in claim 14 further comprising a plurality of ribs extending from an outside of said extension arm.

16. The multi-purpose stationary assembly as claimed in claim 14 further comprising a pad member extending from an outside of said extension arm.

17. The multi-purpose stationary assembly as claimed in claim 14 further comprising two grooves defined in an inside of said first portion, a support means engaged with said roll of adhesive tape and engaged with said two grooves.

18. The multi-purpose stationary assembly as claimed in claim 17, wherein said support means has two parts and each part has a central recess, said roll of adhesive tape located between said two parts and a spring extending through said roll of adhesive tape and engaged between said two central recesses in said two parts.

19. The multi-purpose stationary assembly as claimed in claim 18, wherein each part has a shaft extending therefrom and a dent defined in a bottom defining each groove, said two respective shafts rotatably supported in said two dents.

20. The multi-purpose stationary assembly as claimed in claim 18, wherein each part has an extension board extending radially outward therefrom, one of said extension boards having pins extending therefrom and the other extension board having holes defined therein for receiving said pins therein.

21. The multi-purpose stationary assembly as claimed in claim 13 further comprising two first flanges extending from two sides of a distal end defining said open end, said second portion having two second flanges extending from two sides of an end of said second portion, said two first flanges respectively contacting said second flanges so as to define a slot between said two first flanges and said two second flanges.

22. The multi-purpose stationary assembly as claimed in claim 21, wherein said distal end defining said open end of said first portion has two protrusions extending therefrom, said two protrusions located between said two first flanges, a flexible plate extending from said end having said second flanges of said second portion and said flexible plate located between said two second flanges.

23. The multi-purpose stationary assembly as claimed in claim 22 further comprising an inclined surface defined in a top of each protrusion, an inclined surface defined in a top of said flexible plate.

24. The multi-purpose stationary assembly as claimed in claim 21 further comprising a plurality of first tubes extending from said distal end defining said open end of said first portion, each first tube having a threaded recess defined therein, a plurality of second tubes extending from said end having said second flanges and said second tubes located in alignment with said first tubes.

* * * * *